US006186753B1

(12) United States Patent
Hugenroth et al.

(10) Patent No.: US 6,186,753 B1
(45) Date of Patent: Feb. 13, 2001

(54) APPARATUS FOR MINIMIZING OIL LEAKAGE DURING REVERSE RUNNING OF A SCROLL COMPRESSOR

(75) Inventors: Jason J. Hugenroth, Hope; Thomas R. Barito, Arkadelphia, both of AR (US)

(73) Assignee: Scroll Technologies, Arkadelphia, AK (US)

( * ) Notice: Under 35 U.S.C. 154(b), the term of this patent shall be extended for 0 days.

(21) Appl. No.: 09/307,664

(22) Filed: May 10, 1999

(51) Int. Cl.[7] ..... F01C 1/02

(52) U.S. Cl. ..... 418/55.1; 418/55.6; 418/270; 418/DIG. 1

(58) Field of Search ..... 418/55.1, 55.6, 418/270, DIG. 1

(56) References Cited

U.S. PATENT DOCUMENTS

| | | | | |
|---|---|---|---|---|
| 4,545,747 | * | 10/1985 | Tamura et al. | 418/55.1 |
| 5,496,160 | | 3/1996 | Richardson, Jr., et al. . | |
| 5,533,875 | | 7/1996 | Crum, et al. . | |

FOREIGN PATENT DOCUMENTS

| | | | | |
|---|---|---|---|---|
| 60-101296 | * | 6/1985 | (JP) | 418/55.1 |
| 0177481 | * | 7/1989 | (JP) | 418/55.1 |
| 0005787 | * | 1/1990 | (JP) | 418/55.6 |
| 0043691 | * | 2/1991 | (JP) | 418/55.1 |
| 3-096679 | | 4/1991 | (JP) . | |
| 404330393 | * | 11/1992 | (JP) | 418/55.1 |
| 58200019 | * | 11/1992 | (JP) | 418/55.1 |
| 5302579 | | 11/1993 | (JP) . | |
| 6-272678 | | 9/1994 | (JP) . | |

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

A scroll compressor having an apparatus for minimizing oil leakage during reverse running is provided. The compressor includes a suction tube for allowing gas to enter the compressor housing. One oil minimizing apparatus is a check valve disposed at the suction tube having a spring normally biased against the inlet suction tube so as to prevent oil from exiting the suction tube during reverse running of the motor of the compressor. An alternative oil minimizing apparatus is an oil dam extending longitudinally above the suction tube on an inner surface of the compressor housing. The oil dam bends circumferentially with the inner surface for draining oil along the inner surface away from the suction tube.

11 Claims, 2 Drawing Sheets

APPARATUS FOR MINIMIZING OIL LEAKAGE DURING REVERSE RUNNING OF A SCROLL COMPRESSOR

BACKGROUND OF THE INVENTION

This invention relates to apparatuses for minimizing oil leakage during reverse running of scroll compressors.

Scroll compressors include compressors mounted within a sealed housing structure. The sealed housing structure receives a compressor pump unit and an electric motor for driving the compressor pump unit. Refrigerant and oil are allowed to flow within the compressor housing to perform various functions such as cooling the motor, etc.

Scroll compressors are designed to operate in one direction. Gas enters the housing via a suction tube. The gas flows into compression chambers in the compressor where it is compressed and discharged via an outlet tube. If the power input lines leading from a power supply to the motor are misconnected, however, an improper phasing of the voltage may be supplied and the motor may run in reverse. In this situation, gas is being pumped from the outlet tube toward the suction tube.

During this reverse running mode, oil mixed with gas may be pumped out of the suction tube. This is undesirable, as the compressor could soon run low on oil.

Scroll compressors are typically one of two types. In a "high side" compressor, the housing section which encloses the motor is at a high pressure. The section receives compressed gas from the outlet tube. In this type compressor, the suction tube is connected directly into the scroll pump unit. Check valves have been placed on high side suction tubes.

In a "low side" compressor, the suction tube communicates with the housing portion that encloses the motor. Check valves have not been placed on the suction tube in "low side" compressors.

SUMMARY OF THE INVENTION

It is an object of the present invention to minimize the amount of oil that is pumped out of a scroll compressor during reverse running.

In carrying out the above object, and other objects, features and advantages of the present invention an apparatus is provided for minimizing oil leakage during reverse running of a scroll compressor. The scroll compressor includes means for preventing oil from draining out of the suction tube during reverse running of the compressor.

In a first embodiment of the present invention the means for preventing oil leakage is a check valve disposed at the suction tube. The valve has a spring biasing the valve to close the suction tube, and prevent refrigerant and oil from exiting the suction tube during reverse running of the compressor.

Preferably, the check valve has a stem portion and a land portion. The spring circles the stem portion and rests on the land portion. The land portion lies adjacent the suction tube, and selectively closes the tube. A baffle plate is mounted in the compressor housing, and has side walls extending inwardly from an inside surface of the compressor housing and a rear wall extending between the side walls. The baffle plate further includes an opening receiving the check valve stem portion and providing a reaction surface for the spring.

In a second embodiment of the present invention, the means for preventing oil leakage during reverse running is an oil dam that extends longitudinally above the suction tube on an inner wall of the compressor housing and bends circumferentially with the inner wall. The oil dam separates entrained oil from the refrigerant. Preferably, the dam is structured to drain oil axially along the inner wall away from the suction tube. The oil dam preferably includes an upper end and a lower end, with the upper end extending radially inwardly from the inner surface and the lower end attached to the inner housing surface.

These and other objects, features and advantages of the present invention can be best understood from the following specification and drawings, the following of which is a brief description.

DETAILED DESCRIPTION OF THE PREFERRED EMBODIMENT

Figure 1:
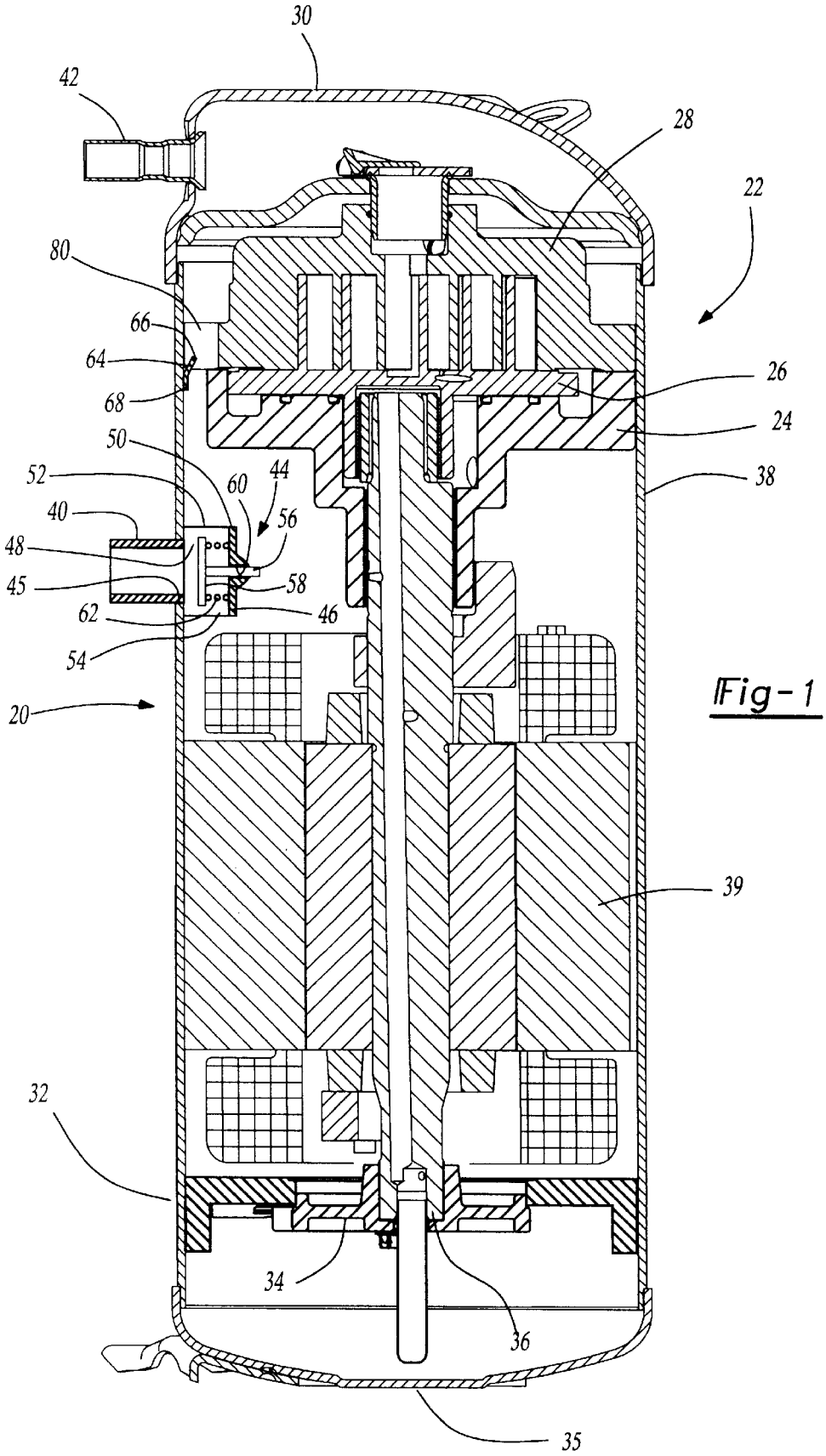
FIG. 1 is a cross-sectional view of two alternative oil leakage minimizing apparatus incorporated in the compressor housing.

FIG. 1 is a cross-sectional view of a scroll compressor incorporating the inventive oil leakage minimizing apparatuses. The scroll compressor 20 receives a pump unit 22 including a crankcase 24, an orbiting scroll 26, and a non-orbiting, or fixed scroll 28. Generally, the pump unit 22 is preassembled and then mounted into the compressor as a unit. An endcap 30 encloses the top end of the compressor 20.

A lower bearing mount 32 receives a lower bearing 34. A lower endcap 35 closes the lower end of the compressor. The bearing 34 mounts a shaft 36. Between the endcaps 30 and 35 a generally cylindrical housing 38 receives and encloses all components 24, 26, 28, 30, 32, 34, 36 and a motor 39.

Gas first enters into the low pressure area of the compressor 20 via a suction tube 40. After being compressed by scrolls 26, 28, the gas exits the high pressure area of the compressor 20 via an outlet tube 42. The outlet tube 42, as well as the high pressure area, is sealed from the suction tube 40 and the low pressure area.

Figure 2:
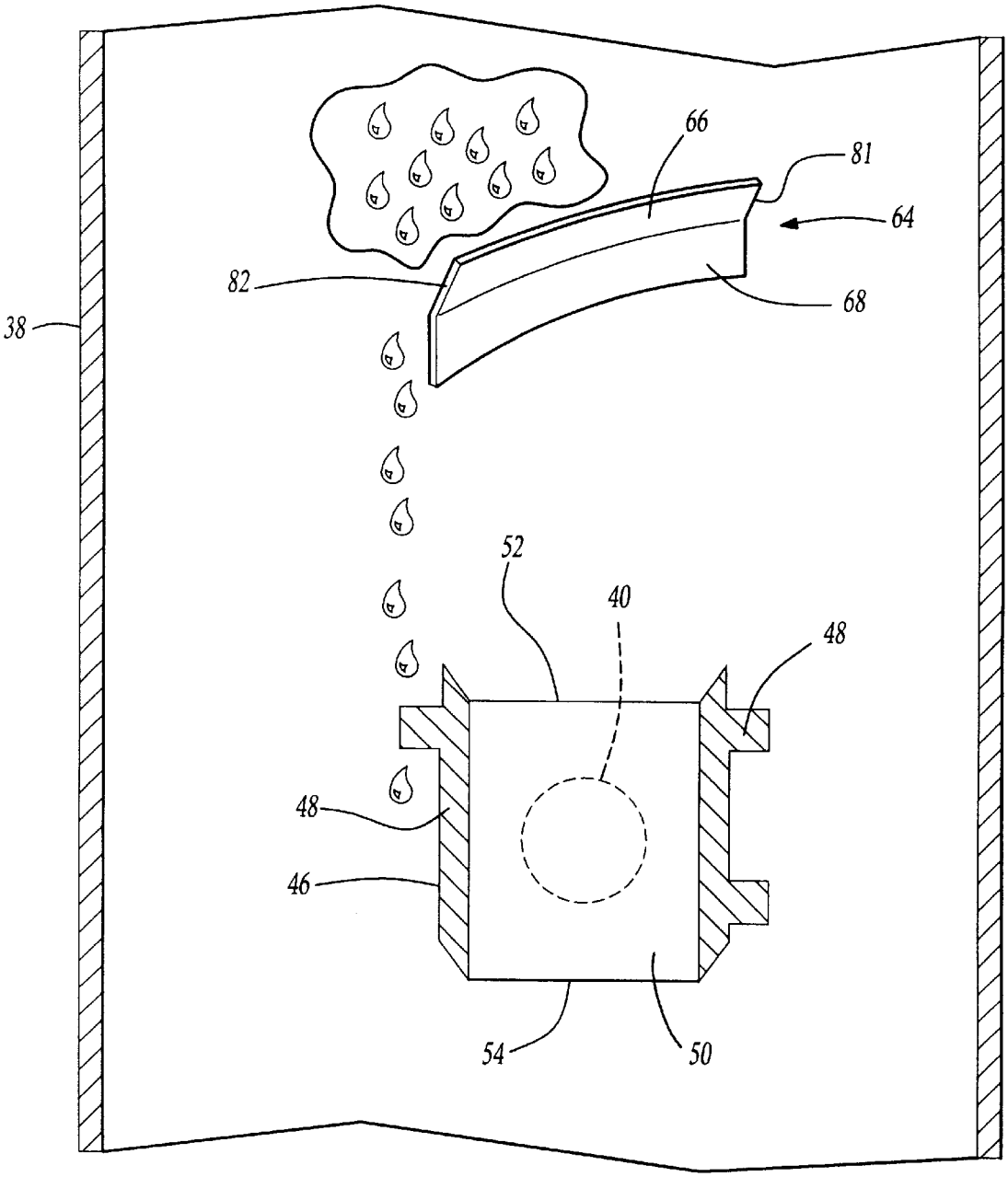
FIG. 2 is a front view of the oil dam of the present invention.

Scroll compressor 20 includes a fixed inlet baffle plate 46, shown in FIGS. 1 and 2. As can be seen in the Figures, baffle plate 46 has side walls 48 extending outwardly from the inside surface of housing 38 and a rear wall 50 extending between side walls 48. Thus, baffle plate 46 has top and bottom openings 52, 54, respectively, that allow the incoming gas to pass into the compressor chamber.

In a first embodiment of the present invention, a check valve 44 is disposed adjacent opening 45 of the suction tube 40 and mounted in the baffle plate 46. While check valve 44 can be any structure, a T-shaped member having a stem portion 56 and a land portion 58 is illustrated. The stem portion extends through an opening 60 of baffle plate 46. The land portion 58 lies adjacent to opening 45 of suction tube 40.

Check valve 44 further includes a spring 62 circling the stem portion 56 and disposed between the land portion 58 and the baffle rear wall 50. The spring 62 biases the check valve 44 against the opening 45 of suction tube 40. During normal operation of the compressor, gas entering the suction tube 40 easily forces the valve 44 against spring 62 to open. The gas thus enters the compressor housing.

However, during reverse running mode, the gas will actually assist in closing the check valve. The spring 62 holds the check valve 44 against the opening 45 of suction tube 40 so that gas and/or oil cannot exit the suction tube 40.

In an alternative embodiment, an oil dam 64, shown in FIGS. 1 and 2, is utilized to minimize oil leakage during reverse running. The oil dam could be used in combination with the check valve, or separately. The oil dam 64 extends longitudinally above the suction tube 40 while bending circumferentially with the inside of the housing 38. The upper end 66 of the dam 64 extends radially inwardly from the inside surface of the housing 38, as shown in FIG. 1. The lower end 68 is adhered directly to the inside surface. During reverse rotation, the oil dam will tend to separate oil entrained in gas being driven from the compression chambers through suction port 80, and towards the suction tube 40. As can be appreciated from FIG. 2, oil dam 64 is angled downwardly from a side 81 toward a side 82. In this way oil collecting in dam 64 is directed to the side of opening 52, and will not be in gas escaping tube 40. Thus, any oil separated by the inside surface drips into the oil dam 64 where it is directed away from the suction tube 40 toward side 82 before the gas exits the suction tube 40.

The present invention thus limits oil leakage upon reserve running in a scroll compressor. This reduces the detrimental effect of reverse running.

Although a preferred embodiment has been disclosed, a worker of ordinary skill in the art would recognize that certain modifications come within the scope of the invention. For that reason, the following claims should be studied to determine the true scope and content of this invention.

What is claimed is:

1. A scroll compressor comprising:

a compressor pump unit;

a motor for driving said compressor pump unit;

a housing including a center shell and end caps at axial ends of said center shell and surrounding said compressor pump unit and said motor;

a suction tube mounted within said center shell for allowing gas to enter said housing and to communicate suction gas within said center shell and for passing over said motor and passing to said compressor unit; and a check valve disclosed at said suction tube for preventing oil from exiting said suction tube during reverse running of said motor.

2. The scroll compressor as recited in claim 1 wherein said check valve has a spring biasing the valve against said suction tube.

3. A scroll compressor comprising:

a compressor pump unit;

a motor for driving said compressor pump unit;

a housing surrounding said compressor pump unit and said motor;

a suction tube for allowing gas to enter said housing;

means for preventing oil from draining out of the suction tube during reverse running of said motor;

a check valve disposed at said suction tube to prevent oil from exiting said suction tube during reverse running of said motor;

said check valve has a spring biasing the valve against said suction tube; and said housing further includes a baffle plate having side walls extending inwardly from an inside surface of said housing said housing and a rear wall extending between said side walls, said baffle plate further including an opening for mounting said check valve and for providing a reaction surface for said spring.

4. The scroll compressor as recited in claim 3 wherein said means for preventing further includes an oil separator extending longitudinally above said suction tube on an inner surface of said housing.

5. The scroll compressor as recited in claim 4 wherein said oil separator bends circumferentially with said inner surface.

6. The scroll compressor as recited in claim 5 wherein said oil separator is an oil dam including an upper end and a lower end, said upper end extending radially inwardly from the inner surface and said lower end adhered to said inner surface for draining oil along the inner surface away from said suction tube.

7. The scroll compressor as recited in claim 6, wherein said oil dam extends downwardly along a circumferential direction to direct oil to flow in one direction.

8. A scroll compressor comprising;

a compressor pump unit;

a motor for driving said compressor pump unit;

a housing surrounding said compressor pump unit and said motor;

a suction tube for allowing gas to enter said housing;

means for preventing oil from draining out of the suction tube during reverse running of said motor;

said means for preventing is an oil separator extending longitudinally above said suction tube on an inner surface of said housing.

9. The scroll compressor as recited in claim 8 wherein said oil separator bends circumferentially with said inner surface.

10. The scroll compressor as recited in claim 9 wherein said oil separator is an oil dam including an upper end and a lower end, said upper end extending radially inwardly from the inner surface and said lower end adhered to said inner surface for draining oil along the inner surface away from said suction tube.

11. The scroll compressor as recited in claim 10, wherein said oil dam extends downwardly along a circumferential direction to direct oil to flow in one direction.

* * * * *

UNITED STATES PATENT AND TRADEMARK OFFICE

CERTIFICATE OF CORRECTION

PATENT NO. : 6,186,753 B1
DATED : February 13, 2001
INVENTOR(S) : Jason J. Hugenroth and Thomas R. Barito It is certified that error appears in the above-identified patent and that said Letters Patent is hereby corrected as shown below:

Title page,
Item [73], Assignee, Scroll Technologies, Arkadelphia, AR (US)

Signed and Sealed this

Sixteenth Day of April, 2002

*Attest:*

*Attesting Officer*

JAMES E. ROGAN
*Director of the United States Patent and Trademark Office*